US005151208A

United States Patent [19]

Huijben et al.

[11] Patent Number: 5,151,208

[45] Date of Patent: Sep. 29, 1992

[54] DETERGENT POWDERS AND PROCESS FOR THEIR PREPARATION

[75] Inventors: Gregorius J. Huijben, Vlaardingen; Cornelis G. van Kralingen, Nieuwerkerk a/d/ IJssel; Seeng D Liem, Rhoon; Michele E. Paoli, Vlaardingen, all of Netherlands

[73] Assignee: Lever Brothers Company, Division of Conopco, Inc., New York, N.Y.

[21] Appl. No.: 679,166

[22] Filed: Mar. 26, 1991

Related U.S. Application Data

[63] Continuation of Ser. No. 399,387, Aug. 25, 1989, abandoned, which is a continuation of Ser. No. 180,660, Mar. 29, 1988, abandoned, which is a continuation of Ser. No. 36,610, Apr. 10, 1987, abandoned.

[30] Foreign Application Priority Data

Apr. 14, 1986 [GB] United Kingdom ..... 8609044

[51] Int. Cl.[5] ..... C11D 3/10

[52] U.S. Cl. ..... 252/174.14; 252/174; 252/174.25; 252/540

[58] Field of Search ..... 252/135, 140, 145, 174.14, 252/174.19, 174.25, 174, 540

[56] References Cited

U.S. PATENT DOCUMENTS

| | | | |
|---|---|---|---|
| 4,274,975 | 6/1981 | Corkill et al. | 252/140 |
| 4,368,134 | 1/1983 | Kaeser | 252/140 |
| 4,460,491 | 7/1984 | Liem | 252/135 |
| 4,861,503 | 8/1989 | Hollingsworth et al. | 252/135 |
| 4,923,628 | 5/1990 | Appel et al. | 252/135 |

FOREIGN PATENT DOCUMENTS

| | | |
|---|---|---|
| 0240356 | 10/1987 | European Pat. Off. . |
| 0242141 | 10/1987 | European Pat. Off. . |
| 1399966 | 7/1975 | United Kingdom . |
| 1473201 | 5/1977 | United Kingdom . |
| 2003913 | 3/1979 | United Kingdom . |
| 1595769 | 8/1981 | United Kingdom . |
| 2085858 | 5/1982 | United Kingdom . |
| 2097419 | 11/1982 | United Kingdom . |
| 2149418 | 6/1985 | United Kingdom . |

*Primary Examiner*—Hoa Van Le

*Attorney, Agent, or Firm*—Gerard J. McGowan, Jr.

[57] ABSTRACT

Detergent powders built with sodium carbonate and having improved flow properties are prepared by a process in which a selected acid, for example, succinic acid or alkylbenzene sulphonic acid, is added to a slurry in order to transform sodium carbonate into needle-like crystals of sodium sedquicarbonate, and the slurry is then dried, preferably spray-dried, to form a powder.

18 Claims, No Drawings

DETERGENT POWDERS AND PROCESS FOR THEIR PREPARATION

This is a continuation application of Ser. No. 07/399,387, filed Aug. 25, 1989; which, in turn, is a Rule 62 continuation of Ser. No. 180,660, filed Mar. 29, 1988, which is a continuation of Ser. No. 036,610 filed Apr. 10, 1987 all now abandoned.

TECHNICAL FIELD OF THE INVENTION

The present invention relates to detergent powders containing sodium carbonate, and to a process for preparing these detergent powders.

BACKGROUND AND PRIOR ART

Sodium carbonate is an effective detergency builder which can be used wholly or partially to replace sodium tripolyphosphate (STP) in detergent powders, but it has disadvantages with respect to the production of spray-dried powders having satisfactory physical properties. STP is an outstandingly good matrix or "building block" material for carrying the organic components, for example, surfactants, of a detergent composition, and also gives powders of good structure, that is to say, powders consisting of strong, non-friable agglomerates of the primary particles formed during spray-drying. Sodium carbonate, unlike STP, is a poor matrix material: under normal ambient conditions it is constantly picking up and losing moisture as conversion from anhydrous salt to monohydrate and vice versa takes place.

It has now been discovered that the incorporation of succinic acid, or certain other acids, in free acid form in a slurry containing sodium carbonate causes its transformation into sodium sesquicarbonate of a crystal size and morphology that render it especially effective as a powder matrix. On spray-drying, a powder containing needle-like crystals of sodium sesquicarbonate having excellent matrix or "building block" properties is obtained. While succinic acid is not the only acid that may be used, it is an especially beneficial choice since the other product of its reaction with sodium carbonate in the slurry is sodium succinate which is itself an excellent structurant. Another preferred acid is linear alkylbenzene sulphonic acid, in which case the other product of the reaction is the detergent active material, sodium linear alkylbenzene sulphonate.

The use of succinic acid salts as structurants in powders built with aluminosilicates has already been proposed. EP 61 295B (Unilever) discloses detergent powders built with zeolite and structured with water-soluble salts of succinic acid. Low or zero phosphate powders low in silicate and structured with water-soluble salts of succinic acid and anionic polymers are disclosed in our copending application claiming the priority of British Patent Application No. 85 26999 filed on Nov. 1, 1985.

The present invention is relevant to the production of whole detergent powders, purely inorganic carrier materials intended for incorporation in detergent powders, or any intermediate product.

SUMMARY OF THE INVENTION

In a first aspect, the present invention provides a process for the production of a powder suitable for use as a detergent composition or a component thereof, which includes the steps of:

(i) preparing an aqueous slurry comprising:

(a) from 8 to 80% by weight of sodium carbonate, (b) optionally other inorganic salts, but not more that 2% of sodium alkaline silicate, and if sodium bicarbonate is present the weight ratio of sodium bicarbonate to sodium carbonate does not exceed 1:3;

(c) optionally one or more anionic and/or nonionic detergent-active compounds and/or other detergent components;

(ii) adding to the slurry, simultaneously with or later than the addition of the sodium carbonate, an acid capable of converting sodium carbonate to sodium sesquicarbonate, the acid being added in an amount of from 0.05 to 0.8 equivalents per mole of sodium carbonate;

(iii) drying the resulting slurry to form a powder containing sodium sesquicarbonate in the form of needle-like crystals;

all percentages being based on the dried powder.

In a second aspect, the invention provides a powder suitable for use as a detergent composition or a component thereof, the powder being prepared by the process of the previous paragraph.

DETAILED DESCRIPTION OF THE INVENTION

The technical basis of the present invention is the reaction of certain acids with sodium carbonate in a slurry to form sodium sesquicarbonate of a particularly favourable particle size and morphology. Provided that sufficient of this material (plus other matrix materials, if used) is present, drying of the slurry will give a powder having excellent physical properties.

The method preferred for drying the slurry is spray-drying, and for convenience the powder prepared by step (iii) will be referred to hereinafter as the spray-dried powder, but it should be remembered that other drying methods such as drum drying are also within the scope of the invention.

The sodium sesquicarbonate in the powder prepared in accordance with the invention is in the form of needle-like crystals: these can be detected qualitatively, and in some powders quantitatively, by means of X-ray diffraction. These crystals will generally have particle sizes ranging from $0.1\times10\ \mu m$ to $20\times200\ \mu m$, the particle size being measurable by scanning electron microscopy or optical microscopy. The smaller the crystals, the better their matrix properties.

It should be emphasized that sesquicarbonate of the correct crystal form cannot be obtained simply by including both sodium carbonate and sodium bicarbonate in the desired proportions in the slurry, and indeed the inclusion of large amounts of sodium bicarbonate in the slurry is undesirable: crystals of a different morphology (platelets) and an unsuitable size are then obtained. The weight ratio of sodium bicarbonate to sodium carbonate should not exceed 1:3, and advantageously the slurry does not contain more than 2% by weight, based on the dried powder, of sodium bicarbonate.

It is also important that the slurry should not contain more than 2% by weight, preferably not more than 1% by weight, of sodium alkaline silicate, based on the dried powder. This is because it tends to cause decomposition of any sodium sesquicarbonate formed in the slurry back to sodium carbonate. If an alkali metal aluminosilicate is present in the slurry, as described in more detail below under "Preferred Embodiments", there is an additional reason for avoiding sodium alkaline silicate except at very low levels: agglomeration of aluminosilicate in the slurry can occur and the resulting large particles can persist through drying into the final powder and then throughout the wash process, where they are slow to disperse. Alkaline silicates are those having a $SiO_2$ $Na_2O$ ratio lower than about 2.5, and include metasilicate (ratio 1.0). Neutral silicate (ratio 3.3:1) can be tolerated in the slurry in higher amounts, but high levels can cause unworkably high viscosities with some slurry formulations.

The needle-like sodium sesquicarbonate forming part or whole of the matrix of the detergent powders of the invention is generated by reaction of the sodium carbonate, included in the slurry, with an acid. The extent of conversion of sodium carbonate to sodium sesquicarbonate that takes place in the slurry will depend on the acid chosen and the amount in which it is used. The reaction between sodium carbonate and a notional monobasic acid HX to form sodium sesquicarbonate is in accordance with the following equation:

$$2Na_2CO_3+HX+2H_2O \rightarrow Na_2CO_3.NaHCO_3.2H_2O+NaX$$

Thus the reaction requires 0.5 equivalents of acid per mole of sodium carbonate. This reaction competes with the more familiar acid/carbonate reaction in which carbon dioxide is generated:

$$Na_2CO_3+2HX \rightarrow CO_2+H_2O+2NaX$$

Here stoichiometry requires 2 equivalents of acid per mole of carbonate.

In order to favour the first reaction at the expense of the second, the acid must not be added to the slurry before the carbonate. Also, the amount of acid used should not substantially exceed the stoichiometric amount required, that is to say, 0.5 equivalents per mole of sodium carbonate. The amount of acid used should be from 0.05 to 0.8 equivalents, preferably from 0.2 to 0.8 equivalents, per mole of sodium carbonate.

It has not proved possible as yet to devise a generic definition of acids that are effective to convert sodium carbonate in a slurry to sodium sesquicarbonate exhibiting the crystal form defined previously. The yield of sodium sesquicarbonate obtained tends to be higher at low slurry moisture contents than at high slurry moisture content. It is generally preferred that the acid should be neither weak nor strong; a $pK_a$ value within the range of from 1.8 to 10, more preferably from 3 to 10, is apparently advantageous. Examples of acids having $pK_a$ values within this range include lower aliphatic polycarboxylic acids, for example, succinic, adipic, glutaric and citric acids; $C_8$–$C_{22}$ fatty acids; and polymeric polycarboxylic acids, for example, polyacrylic acid, acrylic/maleic copolymers and acrylic phosphinate polymers.

An exception to the preference for acids of medium strength is provided by linear $C_8$–$C_{15}$ alkylbenzene sulphonic acids, which are strong ($pK_a$ about 0) but which are effective in the context of the present invention. In principle the acid forms of other sulphonate-type or sulphate-type anionic detergents could also be used.

Some $pK_a$ values (at 20° C. or 25° C.) of acids suitable for use in the process of the invention are as follows:

| Acid | $pK_a$ |
|---|---|
| Succinic | (1) 4.16 |
| | (2) 5.61 |
| Andipic | (1) 4.43 |
| | (2) 5.41 |
| Glutaric | (1) 4.31 |
| | (2) 5.41 |
| Citric | (1) 3.14 |
| | (2) 4.77 |
| | (3) 6.39 |
| Phosphoric | (1) 2.10 |
| | (2) 7.20 |
| Heptanoic | 4.89 |
| Octanoic | 4.89 |
| Nonanoic | 4.96 |
| Linear $C_8$–$C_{15}$ alkylbenzene sulphonic | 0 |

Although it has not proved possible to define the acid to be used in the process of the invention generically in terms of structure of physical or chemical properties, it is possible to establish whether or not a particular acid will be effective in the context of the present invention by preparing a simple "model" slurry containing only sodium carbonate, the acid and water. An aqueous slurry of sodium carbonate is prepared and the acid, in an amount of 0.05 to 0.8 equivalent per mole of carbonate, is added (simultaneously or later) to the slurry. In a simple model slurry of this type, containing only sodium carbonate species, the acid and water, it is possible to detect quite clearly, by optical or electron microscopy, the presence of needle-like sodium sesquicarbonate crystals: crystal size can also be measured.

In the dried powder, the crystals may also be detected both qualitatively and quantitatively by X-ray diffraction. An acid is effective for use in the present invention if needle-like sodium sesquicarbonate crystals having particle sizes within the range of from $0.1\times10$ μm to $20\times200$ μm are detected in the slurry.

On spray-drying, such a slurry will generally give a powder having a dynamic flow rate of at least 90 ml/sec. A corresponding carbonate slurry containing no acid would be expected to give a poor powder, containing both anhydrous sodium carbonate and sodium carbonate monohydrate, and having a considerably lower dynamic flow rate.

It is, of course, possible to calculate how much sesquicarbonate should theoretically be present (assuming 100% conversion) in any powder prepared in accordance with the invention: since sodium carbonate is generally present in at least the stoichiometric amount, this depends only on the amount of acid used.

$$\%\ \text{sesquicarbonate} = 226 \times \frac{\%\ \text{acid}}{\text{equiv. wt. of acid}},$$

where 226 is the molecular weight of sodium sesquicarbonate.

The yield of sodium sesquicarbonate obtained also depends on temperature, since if the temperature is allowed to rise substantially above 100° C. decomposition of sesquicarbonate to carbonate will occur. It is therefore desirable that the process be carried out in such a way that the slurry, and then the dried powder, do not reach a temperature above 100° C., and preferably do not reach a temperature above 90° C. Slurry processing is preferably carried out at a temperature below 80° C, and drying should be carried out at a controlled temperature such that the sesquicarbonate formed in the slurry in retained in the powder. In the case of spray-drying, the air inlet temperature may be considerably higher than 100° C. provided that the temperature of the dried powder at the tower base is below that figure.

One acid preferred for use in the process of the invention is succinic acid. It converts sodium carbonate in slurry, at high yield, to needle-like crystals of which generally at least 90% have particle sizes within the 10–70 μm range. Furthermore, the other product of the reaction, sodium succinate, is an excellent structurant. If desired, succinic acid may be used in the form of Sokalan (Trade Mark) DCS ex BASF, a mixture of succinic, adipic and glutaric acids: the other dicarboxylic acids also participate in the carbonate to sesquicarbonate reaction. Succinic acid is advantageously used in an amount of from 5 to 50% by weight based on the sodium carbonate.

A second preferred acid for use in the process of the invention is detergent-chain-length (generally $C_8$–$C_{15}$) linear alkylbenzene sulphonic acid. The reaction with sodium carbonate then generates needle-like sodium sesquicarbonate and also the anionic surfactant, sodium linear alkylbenzene sulphonate. When the proportions of the various ingredients allow, this method may be used to generate the entire necessary amount of anionic surfactant in the composition. The same principle may be applied to other anionic surfactants available in acid form.

Powders prepared in accordance with the invention exhibit improved powder flow properties as compared with similar powders prepared without the acid, or prepared by a method in which the acid is added to the slurry before addition of the sodium carbonate.

PREFERRED EMBODIMENT OF THE INVENTION

The powder produced by the process of the invention contains, as essential ingredients, needle-like sodium sesquicarbonate, and the sodium salt of the acid used to effect the conversion from carbonate to sesquicarbonate; and various optional ingredients, such as excess sodium carbonate or excess acid depending on the proportions used, and other conventional detergent ingredients, such as anionic and/or nonionic surfactants, and other detergency builders. The powder may amount itself to a fully formulated detergent composition, or it may be useful as a component which on admixture with other ingredients gives a fully formulated detergent composition.

In a first embodiment, the process of the invention may be used to prepare a spray-dried substantially inorganic powder that may be used as a carrier for a liquid detergent ingredient, for example, a nonionic surfactant or a lather suppressor. The carrier may be mixed with a separately prepared base powder to produce a detergent composition. A carrier powder produced in accordance with the invention may, in the simplest case, be prepared just from sodium carbonate and the acid used to effect the conversion from carbonate to sesquicarbonate: the powder will then consist of the needle-like sodium sesquicarbonate characteristic of the invention, the sodium salt of the acid, and generally some unreacted sodium carbonate.

Other substantially inorganic carriers produced in accordance with the invention may contain other materials useful in detergent compositions, for example, crystalline or amorphous sodium aluminosilicate, sodium alkaline silicate or sodium sulphate. As explained below, some of these materials may contribute to the powder matrix.

Inorganic carriers produced in accordance with the invention will generally have dynamic flow rates of at least 90 ml/s.

In a second embodiment, the process of the invention may be used to provide a detergent base powder containing any ingredients of a detergent composition that are compatible with one another and suitable for spray-drying; heat-sensitive ingredients may then be post-dosed to the spray-dried powder. Detergent base powders prepared in accordance with the invention will generally have dynamic flow rates of at least 90 ml/s.

Powders prepared by the process of the invention, both carriers and detergent base powders, may rely on the needle-like sodium sesquicarbonate as the only matrix material. In that case, the amounts of sodium carbonate and acid in the slurry should be chosen to give a sodium sesquicarbonate content of the dried powder of at least 15% by weight, preferably at least 20% by weight. Accordingly, the amount of sodium carbonate in the slurry should be from 15 to 80% by weight (based on the powder) in this embodiment, preferably from 20 to 80% by weight.

Other stable crystalline materials capable of contributing to the powder matrix may, however, also be present, in which case the total matrix material should amount to at least 15% by weight, preferably at least 20% by weight. Materials are capable of contributing to the powder matrix if they form stable crystals that are not constantly gaining and losing water of crystallization or hydration under ambient conditions. Thus crystalline alkali metal aluminosilicates (zeolites) and finely divided calcium carbonate (calcite) are matrix materials, whereas sodium carbonate and sodium sulphate are not. When another matrix material is present in addition to the sodium sesquicarbonate in the powder, the slurry preferably comprises from 8 to 80% by weight of sodium carbonate, more preferably 10 to 60%, and up to 40% by weight of the other matrix material, more preferably from 5 to 40% and especially 10 to 40%; all percentages being based on the dried powder. The total amount of sodium carbonate and other matrix material is preferably at least 15% by weight, more preferably at least 20% by weight, based on the dried powder.

The total matrix material present in a powder prepared by the process of the invention is given by $$\frac{226 \times \%\ \text{acid}}{\text{equiv. wt. of acid}} + \%\ \text{other matrix materials}$$

Two matrix materials are of especial interest in the preparation of phosphate-free detergent base powders by the process of the invention. The first of these is alkali metal aluminosilicate, which of course also functions as a highly efficient detergency builder. Crystalline alkali metal (preferably sodium) aluminosilicates used in this embodiment of the invention have the general formula $$0.8\text{–}1.5\ Na_2O.Al_2O_3.O.8\text{–}6\ SiO_2.$$

These materials contain some bound water and are required to have a calcium ion exchange capacity of at least about 50 mg CaO/g. The preferred sodium aluminosilicates contain 1.5–3.5 $SiO_2$ units (in the formula above) and have a particle size of not more than about 100 μm, preferably not more than about 20 μm and more preferably not more than about 10 μm. These materials can be made readily by reaction between sodium silicate and sodium aluminate, as amply described in the literature.

Suitable crystalline sodium aluminosilcate ion-exchange detergency builders are described, for example, in GB 1 473 201 (Henkel) and GB 1 429 143 (Procter and Gamble). The preferred sodium aluminosilicates of this type are the well-known commercially available zeolite A and X, and mixtures thereof.

If desired, amorphous aluminosilicates may also be included as builders in compositions prepared in accordance with the invention. These, although not strictly speaking crystalline, also contribute to the powder matrix.

The other matrix material of especial interest in the preparation of phosphate-free detergent base powders by the process of the invention is finely divided calcium carbonate, preferably calcite, used as a crystallisation seed to enhance the efficiency of sodium carbonate as a builder, as described and claimed in GB 1 473 950 (Unilever).

Additional non-phosphate builders, for example, nitrilotriacetates or polymeric polycarboxylates, for example, polyacrylates or acrylic/maleic copolymers, may additionally be present in the compositions of the invention if desired.

Although the process of the invention is of especial interest for the preparation of zero-phosphate detergent compositions, it is also beneficial in the context of low-phosphate compositions containing STP or other phosphates in amounts insufficient to provide an adequate powder matrix. The needle-like sesquicarbonate prepared in accordance with the invention may then function in combination with the phosphate to provide the matrix. Powders containing a ternary matrix system, for example, a combined phosphate/aluminosilicate/sesquicarbonate matrix may also be prepared by the process of the invention. As previously indicated, the total amount of matrix material present should generally be at least 15% by weight, preferably at least 20% by weight, based on the dried powder, for acceptable powder properties.

Detergent base powders produced in accordance with the invention will generally contain anionic and/or nonionic surfactants.

Anionic surfactants are well known to those skilled in the detergent art. Examples include alkylbenzene sulphonates, particularly sodium linear $C_8$–$C_{15}$ alkylbenzene sulphonates, more especially those having an average chain length of about $C_{12}$; primary and secondary alcohol sulphates, particularly sodium $C_{12}$–$C_{15}$ primary alcohol sulphates; olefin sulphonates; alkane sulphonates; and fatty acid ester sulphonates. As indicated previously, anionic surfactants may advantageously be incorporated in acid form. Anionic surfactants are typically used in amounts of from 0 to 30% by weight.

Nonionic surfactants that may be used in the process and compositions of the invention include the primary and secondary alcohol ethoxylates, especially the $C_{12}$–$C_{15}$ primary and secondary alcohols ethoxylated with an average of from 3 to 20 moles of ethylene oxide per mole of alcohol. Nonionic surfactants are typically used in amounts of from 0 to 15% by weight.

When both anionic and nonionic surfactants are present, the anionic: nonionic ratio preferably does not exceed 2.5:1.

It may also be desirable to include one or more soaps of fatty acids. The soaps which can be used are preferably sodium soaps derived from naturally occurring fatty acids, for example the fatty acids from coconut oil, beef tallow, or sunflower oil. Soaps are typically used in amounts of from 0 to 5% by weight.

As indicated previously, fatty acids are effective to convert sodium carbonate to needle-like sesquicarbonate in accordance with the invention, the other product of the reaction being the sodium soap of the fatty acid, so soaps are advantageously incorporated indirectly, as the corresponding fatty acids, in the process of the invention.

Anionic surfactants, both soap and non-soap, will generally be incorporated via the slurry, while nonionic surfactants may either be incorporated in the slurry or added subsequently, for example, by spraying on to the base powder, or onto another carrier material which is postdosed.

Fully formulated detergent compositions produced in accordance with the present invention may also contain any other of the ingredients conventionally included, notably anti-redeposition agents; anti-incrustation agents; fluorescers; enzymes; bleaches, bleach precursors and bleach stabilisers; lather suppressors; perfumes; and dyes. These may be added to the aqueous slurry or post-dosed into the spray-dried powder, according to their known suitability for undergoing spray-drying processes.

Powders produced in accordance with the invention and containing bleaches and/or enzymes (postdosed) have been found to have a further major benefit as compared with powders containing a similar amount of unconverted sodium carbonate: the stability of the bleach and/or enzyme is substantially better, and is as good as that exhibited by STP-built powders. Carbonate-built powders are notorious for bleach and enzyme instability because of vapour pressure variations, while powders prepared according to the invention and having a stable matrix comprising needle-like sodium sesquicarbonate exhibit a constant vapour pressure over a wide range of powder moisture contents. The present invention thus provides a route by means of which sodium carbonate may be used in relatively large amounts, as the sole builder, or as a major part of the builder system, in a stable detergent powder containing bleach and/or enzyme. The substantially constant vapour pressure exhibited by powders of the invention also leads to reduced caking as compared with powders based on unconverted sodium carbonate.

The invention is further illustrated by the following non-limiting Examples.

EXAMPLES 1-6

Model Slurry-Making Experiments Using Succinic Acid

Eight slurries of 50% by weight moisture content were prepared from sodium carbonate and solid succinic acid, the acid being added to the slurry-making vessel after the carbonate had been fully dispersed. The compositions (% of slurry solids) are shown in Table 1. The temperature of the slurry-making operation was 60° C. The amounts of succinic acid (based on the carbonate) in each slurry are also shown in Table 1: the molecular weight of succinic acid is 118 and the equivalent weight 59. The slurries were oven-dried at about 50° C. and the weight percentage of the total dried powder constituted by needle-like sodium sesquicarbonate was determined by X-ray diffraction: the level of sodium sesquicarbonate in each slurry had previously been determined by titration. The mean particle sizes of the sesquicarbonate needles in the slurries were also determined by optical microscopy.

It will be seen that when too high a succinic acid level (Comparative Example B) was chosen, no sodium sesquicarbonate needles could be detected. Levels of 11.11 to 42.86% by weight (0.2 to 0.77 equivalents per mole) gave good results, Example 5 representing the closest approach to the stoichiometric proportion of 0.5 equivalents per mole of carbonate.

For comparison a further slurry C. with the same composition as Example 5 was prepared but using the wrong order of addition (acid first, then carbonate). Large volumes of carbon dioxide were evolved and no sesquicarbonate could be detected by optical microscopy.

TABLE 1

EXAMPLES 1-6

| Example | Slurry solids (wt %) sodium carbonate | Slurry solids (wt %) succinic acid | Succinic acid wt % on carbonate | Succinic acid Equivs per mole | Sesquicarbonate (wt % of slurry solids) X-ray | Sesquicarbonate (wt % of slurry solids) Titration | Sesquicarbonate (wt % of slurry solids) Theoretical | mean particle size of sesquicarbonate (μm) |
|---|---|---|---|---|---|---|---|---|
| A | 100.0 | — | — | — | — | — | — | — |
| 1 | 95.0 | 5.0 | 5.26 | 0.1 | 7.4 | 17.4 | 19.2 | — |
| 2 | 90.0 | 10.0 | 11.11 | 0.2 | 21.6 | 32.0 | 38.4 | 5 × (20-50) |
| 3 | 85.0 | 15.0 | 17.65 | 0.31 | 25.8 | 58.0 | 57.4 | 5 × (20-60) |
| 4 | 80.0 | 20.0 | 25.00 | 0.45 | 51.6 | 77.0 | 76.6 | 10 × (20-40) |
| 5 | 78.0 | 22.0 | 28.20 | 0.51 | 45.4 | 86.0 | 84.2 | 10 × (30-120) |
| 6 | 70.0 | 30.0 | 42.86 | 0.77 | 36.6 | 34.0 | 34.0 | 10 × 100 |
| B | 64.0 | 36.0 | 56.25 | 1.01 | 0 | 0 | 0 | — |

EXAMPLES 7-15

Model Slurry-Making Experiments Using Other Acids

The procedure of Examples 1-6 was repeated using nine other acids. The results are shown in Table 2. Again the slurry moisture content was 50%.

All the acids tested were capable of generating some sodium sesquicarbonate in the slurry.

TABLE 2

EXAMPLES 7-13

| Example | Acid | Slurry solids (wt %) sodium carbonate | Slurry solids (wt %) Acid | Acid wt % on carbonate | Acid Equivs per mole | Sesquicarbonate (wt % of slurry solids) X-ray | Sesquicarbonate (wt % of slurry solids) Titration | Sesquicarbonate (wt % of slurry solids) Theoretical |
|---|---|---|---|---|---|---|---|---|
| 7 | Citric | 77.0 | 23.0 | 29.87 | 0.5 | 32.8 | — | 74.2 |
| 8 | Acetic | 78.0 | 22.0 | 28.20 | 0.5 | 53.0 | — | 82.8 |
| 9 | Alkylbenzene sulphonic | 57.0 | 43.0 | 75.44 | 0.25 | 12.0 | 22.0 | 30.0 |
| 10 | Boric | 91.0 | 9.0 | 9.89 | 0.17 | 13.2 | 23.6 | 32.8 |
| 11 | Stearic | 60.0 | 40.0 | 66.67 | 0.25 | 15.4 | — | 32.4 |
| 12 | Sulphuric | 81.0 | 19.0 | 23.46 | 0.50 | 9.2 | 8.6 | 87.6 |
| 13 | Phosphoric | 87.0 | 13.0 | 14.94 | 0.33 | 19.4 | — | 60.0 |

EXAMPLES 14-17 preparation of spray-dried carrier powders

Slurries containing sodium carbonate and an acid (succinic or alkylbenzene sulphonic) were spray-dried to form powders: the slurry formulations are shown in Table 3. The Table also shows powder properties, the actual percentage of sodium sesquicarbonate detected by X-ray diffraction, and the capacity of each powder to absorb nonionic surfactant as determined by titration.

The rather high compressibility figure of the powder of Example 17 was not unexpected in view of its high content of anionic surfactant. Its dynamic flow rate, however, was good.

TABLE 3

EXAMPLES 14-17

| Formulation (slurry solids) | 14 | 15 | 16 | 17 |
|---|---|---|---|---|
| Sodium carbonate | 80.0 | 80.0 | 80.0 | 61.5 |
| Succinic acid | 20.0 | 20.0 | 20.0 | — |
| Linear alkylbenzene sulphonic acid | — | — | — | 35.2 |
| Neutral sodium silicate | — | — | — | 3.3 |
| Slurry moisture content (%) | 50.0 | 50.0 | 40.0 | 54.0 |
| Acid: | | | | |
| wt % of carbonate | 25.0 | 25.0 | 25.0 | 57.2 |
| equivs per mole | 0.45 | 0.45 | 0.45 | 0.19 |
| % sesquicarbonate (X-ray) | 32 | 10 | 38 | 10 |
| Powder moisture content (wt %) | 22.0 | 16.0 | 33.0 | 21.0 |
| Bulk density (g/liter) | 495 | 528 | 795 | 420 |
| Dynamic flow rate (ml/s) | 132 | 114 | 139 | 104 |
| Compressibility (% v/v) | 6 | 7 | 5 | 40 |
| Nonionic absorption (ml/mg) | 204 | 320 | 105 | 130 |

EXAMPLE 18

Preparation of Spray-Dried Zeolite-Containing Base Powder Using Succinic Acid

Spray-dried detergent base powders were prepared by the process of the invention from the ingredients shown in Table 4.

| | D Parts | D % | 18 Parts | 18 % |
|---|---|---|---|---|
| Alkylbenzene sulphonate (Na salt) | 9.0 | 15.5 | 9.0 | 14.4 |

-continued

| | D | | 18 | |
|---|---|---|---|---|
| | Parts | % | Parts | % |
| Nonionic surfactant | 1.0 | 1.7 | 1.0 | 1.6 |
| Zeolite (anhydrous basis) | 22.0 | 37.8 | 22.0 | 35.3 |
| Acrylic/maleic copolymer | 4.0 | 6.9 | 4.0 | 6.4 |
| Sodium carbonate | 12.0 | 20.6 | 12.0 | 19.3 |
| Succinic acid | — | — | 3.34 | 5.4 |
| Minor ingredients (fluorescer, antiredeposition agent etc) | 0.87 | 1.5 | 0.87 | 1.4 |
| Moisture | — | 16.0 | — | 16.0 |
| | | 100.0 | | 100.0 |
| Acid: | | | | |
| % of carbonate | — | | 27.83 | |
| equivs per mole | — | | 0.50 | |
| Bulk density (g/liter) | 520 | | 420 | |
| Dynamic flow rate (ml/s) | 81 | | 123 | |
| Compressibility (% v/v) | 30 | | 18 | |

The slurries, which had a moisture content of 45% by weight, were prepared by a batch process, the succinic acid being incorporated in the slurry after the sodium carbonate. Needle-like crystals of sodium sesquicarbonate could be detected by optical microscopy in the slurry of Example 18.

Spray-drying was carried out under controlled conditions, the powder temperature at the tower base being below 90° C. Sodium silicate, bleach, enzyme, lather suppressor and perfume were subsequently postdosed to the spray-dried base powders to give a total of 100 parts by weight, but the physical properties quoted are those of the spray-dried powder before addition of the postdosed ingredients.

These results show the improvement in powder properties obtained when sodium carbonate is converted to sodium sesquicarbonate in the slurry by means of succinic acid.

EXAMPLES 19-21

Preparation of Spray-dried Zeolite-Containing Detergent Base Powders, Using Other Carboxylic Acids Spray-dried detergent base powders of bulk density 500-550 g/liter were prepared by the process of the invention from the ingredients listed in Tables 5 and 6. Slurries were prepared by a batch process, the acid (Sokalan DCS or succinic acid/fatty acid) in each of Examples 19, 20 and 21 being incorporated in the slurry after the sodium carbonate. The slurry moisture content was about 50% by weight in each case. Needle-like crystals of sodium sesquicarbonate could be detected by optical microscopy in all three slurries.

Spray-drying was carried out under controlled conditions, the powder temperature at the tower base being below 90° C. Sodium silicate, enzyme, lather suppressor and perfume were subsequently postdosed to the spray-dried base powder to give a total of 100% in each case, but the physical properties shown are those of the spray-dried powder before addition of the postdosed ingredients.

Comparative Example E was a base powder containing zeolite and sodium carbonate, but no acid to effect the transformation of the latter material to sesquicarbonate. Examples 19, 20 and 21 were in accordance with the invention, containing respectively Sokalan DCS, Sokalan DCS (with a higher carbonate level), and succinic acid/fatty acid. Comparative Example F demonstrates the effect of spray-drying at too high a temperature so that the sesquicarbonate reverts to sodium carbonate between the slurry stage and the powder stage.

TABLE 5

| EXAMPLES 19-20 | E | | 19 | | 20 | |
|---|---|---|---|---|---|---|
| | Parts | % | Parts | % | Parts | % |
| Alkylbenzene sulphonate (Na salt) | 9.0 | 14.0 | 9.0 | 11.2 | 9.0 | 11.0 |
| Nonionic surfactant | 4.0 | 6.2 | 4.0 | 5.0 | 4.0 | 4.9 |
| Zeolite (anhydrous basis) | 20.0 | 31.1 | 20.0 | 24.8 | 20.0 | 24.4 |
| Sodium carbonate | 20.0 | 31.1 | 25.0 | 31.1 | 30.0 | 36.6 |
| Sodium sulphate | — | — | 2.2 | 2.7 | — | — |
| Sokalan DCS | — | — | 4.0 | 5.0 | 4.0 | 4.9 |
| Fatty acid | — | — | — | — | — | — |
| Minor ingredients (fluorescer, antiredeposition agent etc) | 0.9 | 1.4 | 0.9 | 1.1 | 0.9 | 1.1 |
| Powder moisture content (%) | — | 16.3 | — | 19.1 | — | 17.2 |
| | | 100.0 | | 100.0 | | 100.0 |
| Equivalents of acid per mole of carbonate | — | | 0.25 | | 0.21 | |
| Dynamic flow rate (ml/s) | 80 | | 110 | | 110 | |

TABLE 6

| EXAMPLE 21 | 21 | | F | |
|---|---|---|---|---|
| | Parts | % | Parts | % |
| Alkylbenzene sulphonate (Na salt) | 8.1 | 9.5 | 9.0 | 12.6 |
| Nonionic surfactant | 3.6 | 4.2 | 4.0 | 5.6 |
| Zeolite (anhydrous basis) | 18.0 | 21.0 | 20.0 | 28.0 |
| Sodium carbonate | 27.7 | 32.4 | 20.0 | 28.0 |
| Sodium sulphate | 6.5 | 7.6 | 9.0 | 12.6 |
| Succinic acid | 2.0 | 2.3 | 2.0 | 2.8 |
| Fatty acid | 3.7 | 4.3 | — | — |
| Minor ingredients (fluorescer, antiredeposition agent etc) | 0.8 | 0.9 | 0.9 | 1.3 |
| Powder moisture content (%) | — | 17.6 | — | 9.1 |
| | | 100.0 | | 100.0 |
| Equivalents of acid per mole of carbonate | 0.18 | | 0.18 | |
| Dynamic flow rate (ml/s) | 96 | | 50 | |

EXAMPLES 22-24

Preparation of Spray-Dried Zeolite-Containing Detergent Base Powders Using Alkylbenzene Sulphonic Acid Spray-dried base powders of high bulk density were prepared by the process of the invention from the ingredients listed in Table 7.

In these powders the acid used to effect the conversion of sodium carbonate to needle-like sodium sesquicarbonate was linear alkylbenzene sulphonic acid. Assuming full conversion to sesquicarbonate, the slurries could be assumed to contain:

9.0 parts of alkylbenzene sulphonate (Na salt)
6.0 parts of sodium sesquicarbonate
14.4 parts of sodium carbonate derived from the 8.4 parts of alkylbenzene sulphonic acid and 20.0 parts of sodium carbonate added to the slurry-making vessel.

The slurries of Examples 22 and 24 were prepared by a batch process, the alkylbenzene sulphonic acid being added after the sodium carbonate. The slurry of Example 23 was prepared by a continuous process in which the alkylbenzene sulphonic acid and the sodium carbonate were added simultaneously to the mixer. The slurry moisture content was 40% by weight in each case. Needle-like crystals of sodium sesquicarbonate could be detected in all three slurries by optical microscopy.

Sodium silicate, bleach, enzyme, lather suppressor and additional nonionic surfactant were postdosed to the powders to give a total of 100 parts by weight, but the physical properties quoted are those of the spray-dried base powders prior to addition of the postdosed materials.

The bleach ingredients postdosed included sodium perborate. The powder of Example 24 was analysed for sodium perborate content after 4 weeks' storage at 20° C. and 65% relative humidity, and then again after 8 weeks, and was found to have retained 100% of its sodium perborate content unchanged. Another sample was analysed after 4 weeks' storage under more stringent conditions (37° C., 70% relative humidity) and was found to have retained 100% of its sodium perborate content unchanged.

No caking was observed in the sample stored at 20° C./65% RH, even after 8 weeks. The sample stored at 37° C./70% RH showed a very slight degree of caking after 4 weeks.

A powder containing a corresponding amount of unconverted sodium carbonate would be expected, at 20° C./65% RH, to retain about 80% of its nominal sodium perborate content after 4 weeks, and about 70% after 8 weeks: caking would also be expected.

TABLE 7

| | EXAMPLES 22-24 | | | | | |
|---|---|---|---|---|---|---|
| | 22 | | 23 | | 24 | |
| | Parts | % | Parts | % | Parts | % |
| Alkylbenzene sulphonic acid | 8.4 | 12.8 | 8.4 | 12.8 | 8.4 | 11.2 |
| Nonionic surfactant | 1.0 | 1.5 | 1.0 | 1.5 | 1.0 | 1.3 |
| Zeolite (anhydrous basis) | 24.0 | 36.4 | 24.0 | 36.4 | 24.0 | 31.9 |
| Acrylic/maleic copolymer | 4.0 | 6.1 | 4.0 | 6.1 | 4.0 | 5.3 |
| Sodium carbonate | 20.0 | 30.4 | 20.0 | 30.4 | 28.0 | 37.2 |
| Minor ingredients (fluorescer, antiredeposition agent etc) | 0.83 | 1.3 | 0.83 | 1.3 | 0.83 | 1.1 |
| Powder moisture content | — | 11.6 | — | 11.6 | — | 11.9 |
| | | 100.0 | | 100.0 | | 100.0 |
| Acid: | | | | | | |
| % of carbonate | 42 | | 42 | | 30 | |
| equivs per mole | 0.14 | | 0.14 | | 0.1 | |
| % sesquicarbonate (X-ray) | 4 | | 4 | | 3 | |
| Bulk density (g/liter) | 430 | | 360 | | 445 | |
| Dynamic flow rate (ml/s) | 117 | | 98 | | 116 | |

EXAMPLES 25-27

Preparation of Spray-Dried Zeolite-Containing Detergent Base Powders, Using Alkylbenzene Sulphonic Acid Spray-dried base powders of lower bulk density were prepared by the process of the invention from the ingredients listed in Table 8 (in parts by weight). Slurries were prepared by a batch process, and the slurry moisture content was about 45% in each case. Needle-like crystals of sodium sesquicarbonate could be detected in the slurries by optical microscopy.

In these powders the acid used to effect the conversion of sodium carbonate to needle-like sodium sesquicarbonate was linear alkylbenzene sulphonic acid, which was added to the slurry-making vessel after the sodium carbonate. Assuming full conversion to sesquicarbonate, the slurries could be assumed to contain:

26.0 parts of alkylbenzene sulphonate (Na salt)
16.9 parts of sodium sesquicarbonate
9.0 parts of sodium carbonate derived from the 24.2 parts of alkylbenzene sulphonic acid and 25.0 parts of sodium carbonate added to the slurry-making vessel.

Table 6 shows that the dynamic flow rates of these low-bulk density powders containing high levels of anionic surfactant were excellent.

TABLE 8

| | EXAMPLES 25-27 | | |
|---|---|---|---|
| | 9 | 10 | 11 |
| Alkylbenzene sulphonate acid | 24.2 | 24.2 | 24.2 |
| Nonionic surfactant | 2.0 | 2.0 | 2.0 |
| Zeolite (anhydrous basis) | 25.0 | 25.0 | 25.0 |
| Acrylic/maleic copolymer | 4.0 | 4.0 | 6.0 |
| Sodium carbonate | 25.0 | 25.0 | 25.0 |
| Sodium neutral silicate | — | 4.0 | — |
| Sodium sulphate | 9.0 | 5.0 | 7.0 |
| Minor ingredients (fluorescer, antiredeposition agent etc) | 1.2 | 1.2 | 1.2 |
| Moisture | 6-13 | 13-15 | 8-13 |
| Acid as % of carbonate | 96.80 | 96.80 | 96.80 |
| Equivalents of acid per mole of carbonate | 0.32 | 0.32 | 0.32 |
| Bulk density (g/liter) | 325 | 275 | 285 |
| Dynamic flow rate (ml/s) | 107 | 119 | 115 |

EXAMPLE 28

Preparation of a Zeolite-Free Slurry Using Alkylbenzene Sulphonic Acid and Succinic Acid A slurry was prepared from the ingredients shown in Table 9, by a batch process in which the acids were added after the sodium carbonate to the slurry-making vessel. Sodium sesquicarbonate was the sole matrix material. The slurry moisture content was 40% by weight.

Needle-like crystals of sodium sesquicarbonate could be detected in the slurry by optical microscopy. A sample if the slurry was oven-dried at 50° C. and the resulting powder analysed for sodium sesquicarbonate content by X-ray diffraction.

TABLE 9

| | EXAMPLE 28 | |
|---|---|---|
| | 29 | |
| | Slurry | Slurry solids |
| Alkylbenzene sulphonic acid | 17.6 | 29.33 |
| Sodium carbonate | 33.54 | 55.90 |
| Succinic acid | 2.06 | 3.43 |

TABLE 9-continued

| EXAMPLE 28 | 29 | |
|---|---|---|
| | Slurry | Slurry solids |
| Sodium sulphate | 6.8 | 11.33 |
| Total acid: | | |
| as % of carbonate | 58.62 | 58.62 |
| equivs per mole | 0.28 | 0.28 |
| Sesquicarbonate | | |
| (theoretical) | 20.3 | 33.83 |
| (X-ray) | 17.9 | 29.83 |

EXAMPLES 29-31

Preparation of Spray-Dried Detergent Powders Containing Finely Divided Calcite Spray-dried detergent base powders of bulk density 415-505 g/liter were prepared by the process of the invention from the ingredients listed in Table 8. Slurries were prepared by a batch process, the acid (succinic acid, Sokalan DC5, alkylbenzene sulphonic acid) being added to the slurry-making vessel after the sodium carbonate. The slurry moisture content was about 50% by weight in each case. Needle-like crystals of sodium sesquicarbonate could be detected in the slurries by optical microscopy.

Sodium silicate, bleach, enzyme and lather suppressor were subsequently postdosed to the spray-dried base powder to give a total of 100 parts by weight, but the properties shown in Table 8 relate to the base powder prior to addition of the postdosed material.

In Example 30 one-third of the alkylbenzene sulphonate was incorporated in the slurry in acid form (2.8 parts of acid, equivalent to 3.0 parts of the sodium salt) so that this in addition to the Sokalan DCS would affect the transformation of carbonate to sesquicarbonate.

For each powder the theoretical amount of sodium sesquicarbonate, assuming 100% conversion, was calculated. This plus the amount of calcite present represents the total matrix of the powder.

The powders of Examples 29, 30 and 31 all exhibited good dynamic flow rates and showed no tendency to cake when stored at 30° C./60% RH and 37%/70% RH.

TABLE 8

| EXAMPLES 29-31 | 29 | | 30 | | 31 | |
|---|---|---|---|---|---|---|
| | Parts | % | Parts | % | Parts | % |
| Alkylbenzene sulphonate (Na salt) | 9.0 | 12.6 | 6.0 | 7.0 | 9.0 | 10.5 |
| Alkylbenzene sulphonic acid | — | — | 2.8 | 3.3 | — | — |
| Nonionic surfactant | 4.0 | 5.6 | 4.0 | 4.7 | 4.0 | 4.7 |
| Sodium carbonate | 35.0 | 48.9 | 45.0 | 52.7 | 40.0 | 46.7 |
| Calcite | 10.0 | 14.0 | 10.0 | 11.7 | 15.0 | 17.5 |
| Succinic acid | 2.0 | 2.8 | — | — | — | — |
| Sokalan DCS | — | — | 4.0 | 4.7 | 4.0 | 4.7 |
| Minor ingredients (fluorescer, antiredeposition agent etc) | 0.8 | 1.1 | 0.8 | 0.9 | 0.8 | 0.9 |
| Powder moisture content | | 15.0 | | 15.0 | | 15.0 |
| | | 100.0 | | 100.0 | | 100.0 |
| Sodium sesquicarbonate (theoretical) | 10.9 | | 18.7 | | 16.4 | |
| Acid: | | | | | | |
| wt % of carbonate | 5.71 | | 15.10 | | 10.0 | |
| equivs per mole | 0.10 | | 0.16 | | 0.16 | |
| Bulk density (g/liter) | 415 | | 470 | | 505 | |
| Dynamic flow rate | 90 | | 92 | | 107 | |

We claim:

1. A process for the production of a granular solid suitable for use as a detergent powder or a component thereof, comprising the steps of:
   (i) preparing an aqueous slurry comprising:
      (a) from 8 to 80% by weight of sodium carbonate,
      (b) not more than 2% sodium alkaline silicate,
      (c) the weight ratio of any sodium bicarbonate to the sodium carbonate not exceeding 1:3;
   (ii) adding to the slurry, simultaneously with or later than the addition of the sodium carbonate to sodium sesquicarbonate, the acid being added in an amount of from 0.05 top 0.8 equivalents per mole of sodium carbonate, the resulting slurry having a moisture content of at least 40% by weight;
   (iii) drying the resulting slurry to form a powder containing sodium sesquicarbonate in the form of needle-like crystals;
   the slurry and the dried powder having a temperature which throughout the process does not exceed 90° C., all percentages being based on the dried slurry.

2. A process as claimed in claim 1, wherein step (iii) comprises spray-drying the slurry.

3. A process as claimed in claim 1, wherein the slurry comprises:
   (a) from 8 to 80% by weight of sodium carbonate and
   (b) from 5 to 40% by weight of a stable crystalline material, the total amount of (a) and (b) being at least 15% by weight, all percentages being based on the dried powder.

4. A process as claimed in claim 3, wherein the slurry comprises (a) from 10 to 60% by weight of sodium carbonate and (b) from 10 to 40% by weight of the stable crystalline material.

5. A process as claimed in claim 3, wherein the total amount of (a) and (b) is at least 20% by weight, based on the dried powder.

6. A process as claimed in claim 3, wherein the stable crystalline material is an alkali metal aluminosilicate.

7. A process as claimed in claim 3, wherein the stable crystalline material is finely divided calcium carbonate.

8. A process as claimed in claim 1, wherein the slurry is substantially free of alkali metal aluminosilicates and comprises from 15 to 80% by weight of sodium carbonate.

9. A process as claimed in claim 1, wherein in step (ii) the acid is added in an amount of from 0.2 to 0.8 equivalents per mole of sodium carbonate.

10. A process as claimed in claim 1, wherein the acid added in step (ii) has a $pK_a$ value within the range of from 1.8 to 10.

11. A process as claimed in claim 10, wherein the acid added in step (ii) is succinic acid, in an amount of from 5 to 50% by weight based on the sodium carbonate.

12. A process as claimed in claim 10, wherein the acid added in step (ii) is a fatty acid.

13. A process as claimed in claim 1, wherein the acid added in step (ii) is an alkylbenzene sulphonic acid.

14. A process as claimed in claim 1, wherein the slurry does not contain more than 2% by weight of sodium bicarbonate, based on the dried powder.

15. A process as claimed in claim 1, wherein the slurry is free of inorganic phosphate.

16. A powder suitable for use as a detergent composition or a component thereof, prepared by a process as claimed in claim 1, and having a dynamic flow rate of at least 90 ml/s.

17. The process of claim 1 wherein the slurry includes one or more anionic and/or nonionic detergent active compounds and/or other detergent components.

18. The process as claimed in claim 1, wherein the temperature of the slurry and of the dried powder throughout the process does not exceed 80° C.

* * * * *